US005403349A

United States Patent [19]

Röhrig

[11] Patent Number: 5,403,349

[45] Date of Patent: Apr. 4, 1995

[54] CHILD'S DUMMY

[75] Inventor: Peter Röhrig, Vienna, Austria

[73] Assignee: Mam Babyartikel Gelsellschaft M.B.H., Vienna, Austria

[21] Appl. No.: 188,592

[22] Filed: Jan. 28, 1994

Related U.S. Application Data

[63] Continuation of Ser. No. 910,039, Sep. 30, 1992.

[30] Foreign Application Priority Data

Feb. 9, 1990 [AT] Austria ..... 292/90

[51] Int. Cl.[6] ..... A61J 17/00

[52] U.S. Cl. ..... 606/234; D24/196

[58] Field of Search ..... 606/234–236; D24/194–199

[56] References Cited

U.S. PATENT DOCUMENTS

| | | | |
|---|---|---|---|
| 1,826,943 | 10/1931 | Maker . | |
| 3,777,753 | 12/1973 | Kesselring . | |
| 4,193,407 | 3/1980 | Edmark | 606/234 |
| 4,545,378 | 10/1985 | Chrones . | |
| 4,577,632 | 3/1986 | Grasset | 606/236 |
| 4,867,159 | 9/1989 | Fulton | 606/236 |
| 4,909,253 | 3/1990 | Cook et al. | 606/234 |
| 5,004,473 | 4/1991 | Kalantar | 606/234 |
| 5,078,733 | 1/1992 | Eveleigh et al. | 606/234 |

FOREIGN PATENT DOCUMENTS

| | | | |
|---|---|---|---|
| 0379508 | 6/1985 | Austria | A61J 17/00 |
| 0116003 | 8/1984 | European Pat. Off. | A61J 17/00 |
| 2205817 | 5/1974 | France | A61J 11/00 |
| 2466245 | 4/1981 | France | A61J 17/00 |
| 3241845 | 5/1984 | Germany | A61J 11/00 |
| 3316824 | 11/1984 | Germany | A61J 11/00 |
| 3347876 | 5/1985 | Germany | A61J 17/00 |
| 3530911 | 3/1987 | Germany | A61J 11/00 |
| 0374517 | 6/1932 | United Kingdom | 606/235 |
| 0510754 | 8/1939 | United Kingdom | 606/235 |
| 0016467 | 11/1989 | United Kingdom | 606/235 |

*Primary Examiner*—Stephen C. Pellegrino
*Assistant Examiner*—Glenn K. Dawson
*Attorney, Agent, or Firm*—Ladas & Parry

[57] ABSTRACT

There is disclosed a pacifier including a nipple (3) fastened in a central opening (2) of a shield (1) having perforations (11) at a distance from this central opening (2), wherein the shield (1), on its inner side facing the mouth when in use, comprises a zone (16) provided with nubs (15) radially outwardly of the zone (12) provided with the perforations (11).

20 Claims, 2 Drawing Sheets

CHILD'S DUMMY

This is a continuation of copending application(s) Ser. No. 07/910,039, filed on Sep. 30, 1992, International Application PCT/AT91/00015, filed on Jan. 31, 1991, and which designated the U.S.

FIELD OF THE INVENTION

The invention relates to a pacifier including a nipple fastened in a central opening of a shield having perforations at a distance from this central opening.

UNDERLYING PRIOR ART

A pacifier of this kind is known from AT-B-379 508. There, the perforations provided in the grid-shaped pacifier shield form saliva drainage openings and air-drying openings as well as emergency respiration openings. It has proved that irritations, reddening and inflammations of the skin of an infant in the region of the mouth can be considerably reduced by safeguarding the drainage of saliva and the drying of the skin in the mouth region through such perforations. At the known pacifier, relatively large perforations are provided to this end, thus adversely affecting the stability of the pacifier shield and impairing the contact of the pacifier shield in the mouth region in a manner that the suction comfort is reduced. If, on the other hand, the perforations are smaller, the effect of preventing irritations, reddening and inflammations will be substantially reduced.

In this context, it is noted that investigations have demonstrated that dermatologic changes of the skin of the face in the surroundings of the mouth of babies and infants are caused, in particular, by mycoses, i.e., fungus infections, wherein it is primarily Blastomyces and not Hyphomycetes that are responsible for such skin changes. Accordingly, it is of particular importance to reach as effective a drainage of saliva as possible from the surroundings of the mouth of infants as well as effective an aeration and, thus, dryness of these skin regions as possible, because in that case a markedly slighter fungus infection will occur as has been proved by these investigations.

SUMMARY OF THE INVENTION

Therefore, it is an object of the present invention to provide a pacifier of the initially defined type, which, on the one hand, ensures the effective drainage of saliva and dryness of the mouth region and, on the other hand, guarantees sufficient stability of the pacifier shield, wherein it is also a particular object to reach a close fit of the lips of the infant on stable full surfaces of the pacifier shields so as to avoid the protrusion of parts of the lips through any of the perforations.

In accordance with the invention, the pacifier of the above-mentioned type is characterized in that the shield, on its inner side facing the mouth when in use, comprises a zone provided with nubs radially outwardly of the zone provided with the perforations.

The invention is based on the finding that a solution to the set object will be found by starting with that part of the whole pacifier which gets into contact with the critical zones of the mouth region, i.e., with the pacifier shield. In doing so, it was found that a nub structure provided on the mouth-side surface of the shield in combination with appropriately provided perforations forming saliva drainage and aeration openings will considerably enhance the dryness of the surroundings of the mouth as compared to earlier pacifiers. In connection therewith, the raised nubs, which protrude from the shield surface, cause the skin to get into contact with the shield material only in certain regions, i.e., with the nubs, which skin regions change constantly in terms of place with the pacifier in use due to the suction and chewing motion such that all the skin regions can dry continuously. Residual saliva, which has not flown off through the perforations provided in the shield farther inwards, can readily flow outwards between the nubs, thus also favoring the drying of the skin in the mouth region of the infant.

It should be noted that a combined pacifier and teething ring is known from EP-B-116 003, wherein a part of the teething ring itself is used for fixing the teat. The teething ring is provided with a nub structure on either side in a manner conventional with teething rings, the material of the teething ring, unlike that of a pacifier shield, being sufficiently soft for this biting function.

A particularly advantageous embodiment of the pacifier according to the invention is characterized in that the zone provided with the nubs immediately joins the zone provided with the perforations radially outwardly of the latter, yet a smooth shield zone is provided radially inwardly of the zone provided with the perforations, which is approximately oval in a plan view and surrounds the central openings for the nipple. Thereby, optimum saliva drainage and skin drying are ensured, on the one hand, and the protrusion of the lips through the perforations is prevented, thus promoting the nasal respiration of the infant because of the lip closure. Accordingly, it is further particularly advantageous if the largest extension of the approximately oval smooth shield zone is located in the longitudinal axis of the oval to lemniscate-shaped shield.

For the saliva drainage and drying effects sought, it will then be advantageous, if the zone provided with the nubs substantially extends as far as to the edge of the shield.

With the pacifier according to the invention, the size, shape, number and distribution of the nubs are to be chosen such that, on the one hand, sufficient and soft contact of the pacifier shield with the skin is provided so as to avoid the mechanical irritation of the skin by rubbing edges, and that, on the other hand, sufficient space is left between the nubs for saliva drainage and skin drying. In tests, configurations in which the nubs had the form of cylinders with circular or elliptic bases proved particularly favorable. Moreover, the nubs may have prismatic shapes, e.g., with square, rectangular, triangular or rhomboid bases. To avoid irritations, the surfaces of the nubs suitably are smooth. In that case, it is also advantageous if the nubs have rounded edges and verges. Furthermore, in order to adapt the nubs to the concave curvature of the pacifier shield so as to reach a uniform contact of the pacifier shield with the skin also in the region of the nubbed zone, it is, furthermore, advantageous if all of the nubs are substantially equal in height.

For reasons of manufacture, it is finally favorable if the nubs are molded of the material of the shield. By such an integral molding of the nubs on the pacifier shield, the rounded edges and verges of the nubs are particularly easy to produce, thus obtaining a gradual rounded transition from the nubs into the shield surface proper.

It would also be conceivable to design the nubs approximately semi-spherical or wartlike.

BRIEF DESCRIPTION OF THE DRAWING

In the following, the invention will be explained in more detail by way of exemplary embodiments illustrated in the drawing, to which it is, however, not limited. Therein.

DETAILED DESCRIPTION OF THE PREFERRED EMBODIMENT

Figure 1:
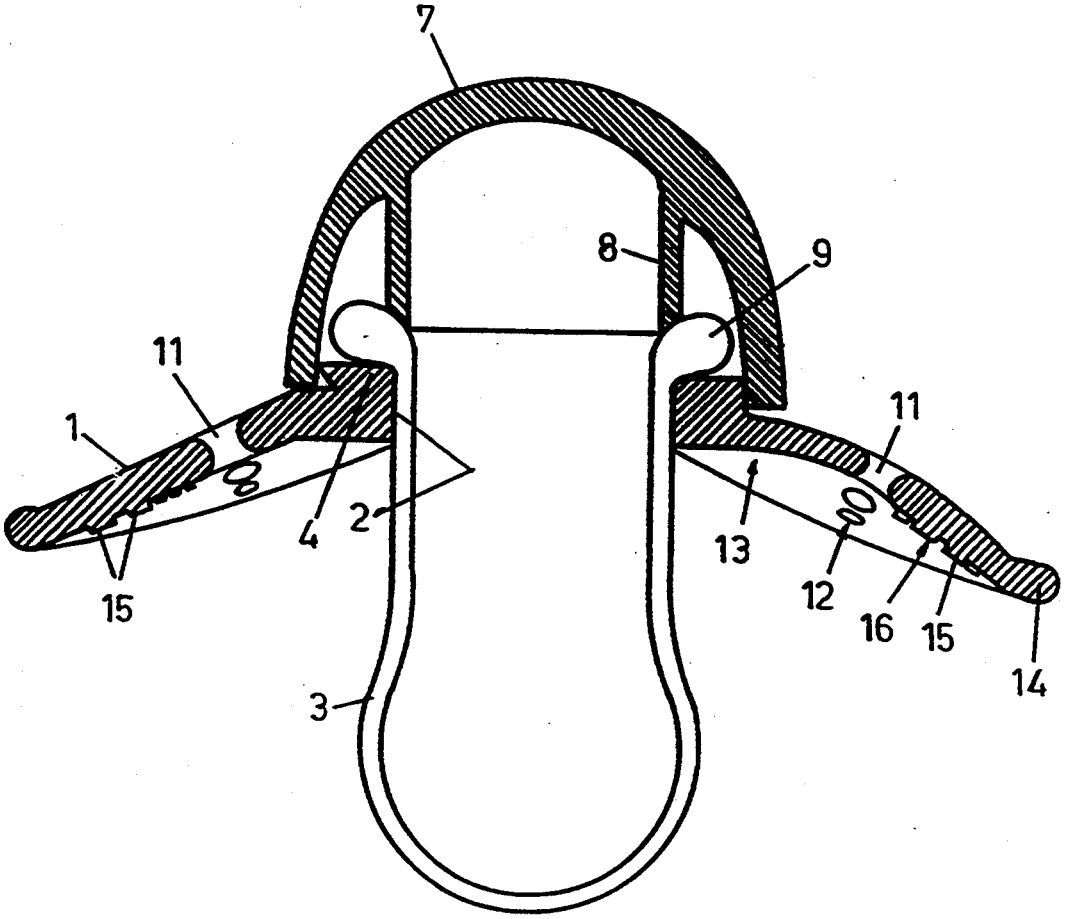
FIG. 1 represents a pacifier in the longitudinal section.

The pacifier represented in FIG. 1, for instance, has a general structure basically corresponding to that of the pacifier according to Austrian Patent No. 379,508. In detail, this pacifier comprises a shield 1 centrally provided with an opening 2, in which a hollow nipple 3 of silicone rubber, caoutchouc or the like is fastened. This nipple 3 has an approximately oval cross section and, accordingly, also the central opening 2 has a generally oval shape, as is apparent from FIG. 2. The shield 1 is substantially plane in the approximately circular zone 4 surrounding the central opening 2 (cf. FIGS. 1 and 2). From this central zone 4, the shield 1 is concavely curved in respect of the nipple 3, with an overall lemniscate shape of the shield 1 being provided, as is apparent from FIG. 2. This lemniscate shape results in indentations 5, 6 (FIG. 2), which, with the pacifier in use, leave a space for the nose of the infant, thus causing the correct positioning of the pacifier in the mouth.

On the side facing away from the nipple 3, i.e., on the external side, a hood-like, for instance, approximately semi-spherically shaped cap 7 is fastened to the shield 1, which includes a tubular clamping projection 8 having an oval cross section, which serves to clamp a thickened end bead 9 of the nipple 3 against the thickened rim of the central opening 2 on the external side of the shield 1. For fixing the cap 7, the shield 1 may comprise on its outer side, for instance, an annular ledge 10 formed of the material of the shield 1, to the outer periphery of which the cap 7 is fastened, e.g., by ultrasonic welding or gluing. In this fastened position of the cap 7, the projection 8, as already mentioned, clamps the end bead 9 against the thickened rim of the opening 2, the bead 9 preventing the nipple 3 from being pulled out of the shield 1 through the opening 2. However, any other fastening techniques are, of course, feasible for retaining the nipple 3 in the shield 1, such as, e.g., fastening by means of wedge-shaped plugs or clamps projecting into the nipple and clamping the nipple against the wall of the opening 2 in a manner known per se. Likewise, the pacifier could, of course, have a basically different structure, for instance, without cap 7, wherein a ring or any other holding means may then, for instance, be provided instead, as is also known per se.

Figure 2:
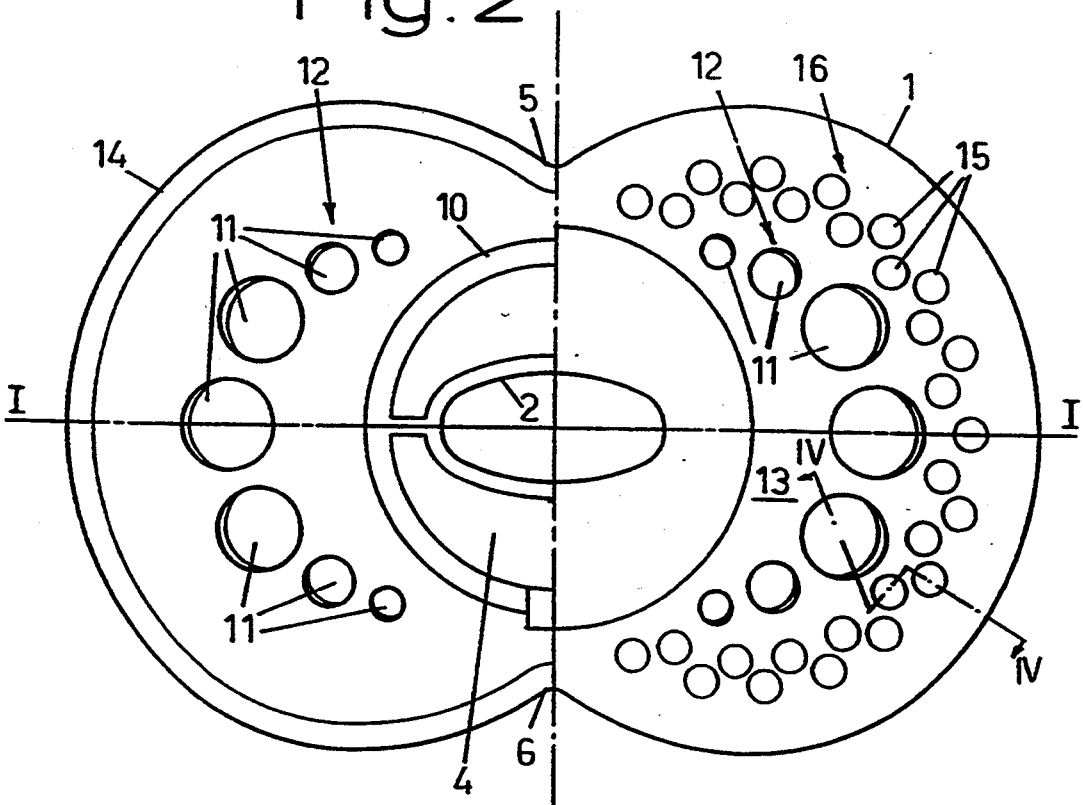
FIG. 2 represents views on a pacifier shield from outside and from inside, respectively, the left-hand half of FIG. 2 being a view of the pacifier shield side facing away from the mouth and the right-hand half of FIG. 2 illustrating a view of the pacifier shield side facing the mouth.

In the shield 1, for instance, circular perforations 11 are provided radially outwardly of the approximately flat circular zone 4, which, in the instant exemplary embodiment, cf. FIG. 2, are located with their centers following two arcs laterally enclosing the central zone 4, which, furthermore, have diameters decreasing from the longitudinal central line I—I (FIG. 2) and which, in this manner, define an approximately sickle-shaped zone of perforations 11, which is generally denoted by 12. If, as illustrated, the diameters of the circular perforations 11 get increasingly smaller from the longitudinal axis I—I, if, furthermore, the perforations 11 are located at approximately equal distances and, as illustrated, extend approximately equidistantly relative to the lemniscate contour of the shield 1, this has proved to roughly correspond to the intensity of the saliva flow to be drained or dried by aid of the perforations 11 and which is the largest in the corners of the mouth; for this reason, the circular perforations 11 located on the longitudinal axis I—I also are the largest, as is apparent from FIG. 2. Besides, the perforations 11 will function as emergency respiration openings if the pacifier plus shield 1 has been taken into the infant's mouth as a whole or even has got into his or her throat. Apart from this, the shape of the perforations 11 need not necessarily be circular, there are other shapes conceivable as well, such as, e.g., oval perforations, rectangular perforations with rounded corners, rhomboid perforations, etc.

Between the two mentioned approximately sickle-shaped zones 12 including the perforations 11 and the central, plane zone 4 or the central opening 2, a smooth shield zone 13 is provided, which is approximately oval in view, the longer extension being located in the direction of the longitudinal axis I—I of the shield 1. The dimensions may be chosen such that the largest longitudinal extension of this approximately oval shield zone 13, i.e., in the direction of the longitudinal axis I—I, corresponds to approximately the size of an infant's mouth such that the largest perforations 11 located on the longitudinal axis I—I actually come to lie in the region of the corners of the mouth, the lips thus being prevented from protruding through the perforations 11 in any event. Moreover, closure of the infant's lips is thereby obtained such that the infant is forced to breathe through the nose.

Figure 4:
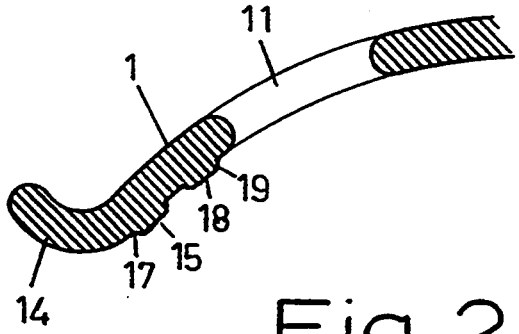
FIG. 4 is a section through the pacifier shield according to line IV—IV of FIG. 2.
Figure 3:
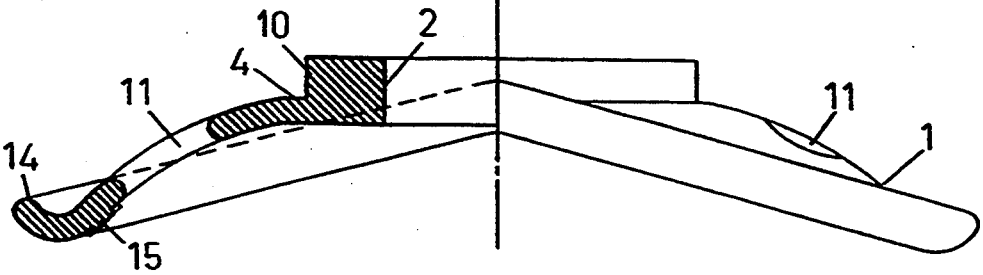
FIG. 3 is a partially sectioned side view of the pacifier shield.

Between the outer boundary line of the perforations 11, i.e., of the imaginary sickle-shaped zones 12, and the outer edge 14 of the shield 1, which may be slightly angular towards outside in a conventional manner, as is apparent from FIGS. 1, 3 and 4, a zone of nubs 15 projecting from the surface of the shield 1 is provided on the side of the shield 1 facing the mouth. In detail, approximately circular-arc-shaped zones 16 with nubs 15 are present outwardly of the two sickle-shaped zones 12 provided with the perforations 11, which nub zones 16 extend radially outwards practically as far as to the angular shield edge 14. As can be seen from FIG. 2, the arrangement of the nubs 15 may be such that two offset rows of nubs 15 are present, the center of each row lying on an approximately circular-arc-shaped line. Any other configurations may, of course, be chosen for the arrangement of the nubs 15 and in some cases the arrangement of the nubs also will depend on the concrete shape of the nubs 15 chosen. In the instant exemplary embodiment, which is the preferred one at present, the nubs 15 are cylindrical having circular bases and are made of the material of the shield 1 with rounded groove-like transitions 17, their surfaces 18 being smooth and adapted to the concave curvature of the shield 1. The nubs 15, furthermore, are provided with rounded front edges 19 to save the infant's skin and to ensure sliding of the nub surfaces without irritating the skin.

Figure 5:
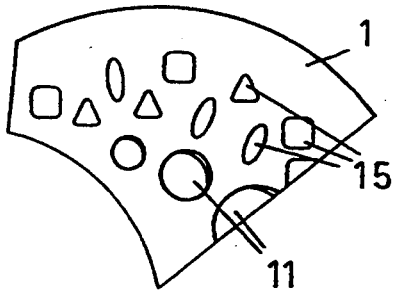
FIG. 5 is a partial plan view similar to the right-hand half of FIG. 2, onto a pacifier shield having nubs modified in respect of the embodiment of FIG. 2.

The nubs 15 may, of course, be designed in any other way, for instance, be wartlike or even be cylindrical, yet with an elliptic base, or prismatic, having approximately rhomboid, rectangular or square or even triangular, but also hexagonal, etc., bases, cf. the schematic illustration in FIG. 5, in which various other possible nub shapes are illustrated as examples. It should be noted that, as a rule, only one special nub form, e.g., circularly cylindrical, will be provided on a given pacifier shield 1, but that it is absolutely conceivable to provide nubs 1 in various shapes, e.g., circularly cylindrical and cylindrical with elliptic bases, on one and the same pacifier shield 1 in combination.

The height of the nubs as well as the total area defined by the nubs 15 in the zones 16, based on the remaining shield surface, i.a., is determined by the size of the pacifier, by the overall cross sectional area of the perforations 11 as well as by the shape of the pacifier shield. Obviously, there is a wide range of possible configurations, the only thing to be taken into consideration when shaping and arranging the nubs 15 substantially being that both an irritation-free contact of the nubs 15 on the skin and a sufficient drainage of saliva not already diverted through the perforations 11 will be ensured. In an arrangement as represented in FIG. 2, the nubs, for instance, may have diameters of about 2 to 3 mm at a height of approximately 0.5 mm.

I claim:

1. A pacifier comprising a nipple fastened in a central opening of a shield concavely curved with respect to the nipple, said shield having a lemniscate-shaped periphery and having an inner side facing toward the nipple and perforations provided two sickle-shaped zones respectively at a distance from said central opening, wherein said inner side of said shield comprises a smooth shield zone provided radially inwardly of the zones of the perforations and surrounding the central opening two arcuate zones each arcuate zone being located between a portion of the periphery of the shield and one of the sickle-shaped zones, and skin contacting nubs provided on the arcuate zones on the inner side of the shield.

2. A pacifier according to claim 1, wherein said shield, and has a longitudinal axis, said smooth shield zone being oval and having a largest extension along the longitudinal axis of the shield.

3. A pacifier according to claim 1, wherein the arcuate zone provided with the nubs substantially extend to the periphery of the shield.

4. A pacifier according to claim 1, wherein the nubs have the form of cylinders having circular bases.

5. A pacifier according to claim 1, wherein the nubs have the form of cylinders having elliptic bases.

6. A pacifier according to claim 1, wherein the nubs have prismatic shapes with square, rectangular, triangular or rhomboid bases.

7. A pacifier according to claim 1, wherein each of the nubs comprises a smooth surface.

8. A pacifier according to claim 1, wherein the nubs have rounded edges.

9. A pacifier according to claim 1, wherein all of the nubs are substantially equal in height.

10. A pacifier according to claim 1, wherein the nubs are molded of a same material of the shield.

11. A pacifier comprising a nipple fastened in a central opening of a shield concavely curved with respect to the nipple, said shield having an oval periphery and having an inner side facing toward the nipple and perforations provided in two sickle-shaped zones respectively at a distance from said central opening, wherein said inner side of said shield comprises a smooth shield zone provided radially inwardly of the zones of the perforations and surrounding the central opening, two arcuate zones each arcuate zone being located between a portion of the periphery of the shield and one of the respective sickle-shaped zones, and skin contacting nubs provided on the arcuate zones on the inner side of the shield.

12. A pacifier according to claim 11, wherein said shield has a longitudinal axis, said smooth shield zone being oval and having a largest extension along the longitudinal axis of the shield.

13. A pacifier according to claim 11, wherein the arcuate zones provided with the nubs substantially extend to the periphery of the shield.

14. A pacifier according to claim 11, wherein the tubs have the form of cylinders having circular bases.

15. A pacifier according to claim 11, wherein the nubs have the form of cylinders having elliptic bases.

16. A pacifier according to claim 11, wherein the nubs have prismatic shapes with square, rectangular, triangular or rhomboid bases.

17. A pacifier according to claim 11, wherein each of the tubs comprises a smooth surface.

18. A pacifier according to claim 11, wherein the nubs have rounded edges.

19. A pacifier according to claim 11, wherein all of the nubs are substantially equal in height.

20. A pacifier according to claim 11, wherein the nubs are molded of a same material of the shield.

* * * * *

UNITED STATES PATENT AND TRADEMARK OFFICE

CERTIFICATE OF CORRECTION

PATENT NO. : 5,403,349

DATED : April 4, 1995

INVENTOR(S) : Peter ROHRIG

It is certified that error appears in the above—identified patent and that said Letters Patent is hereby corrected as shown below:

Title page, Section [73] delete "Gelsellschaft" and insert --Gesellschaft--;

Title page, item [63] insert,

--[63] Division of Ser. No. 910,039, filed Sep 30, 1992, now abandoned, which was the national stage of international application number PCT/AT91/00015, filed Jan. 31, 1991--

Signed and Sealed this

Twenty-sixth Day of December, 1995

Bruce Lehman

*Attest:*

BRUCE LEHMAN

*Attesting Officer*

*Commissioner of Patents and Trademarks*